US009263003B2

(12) United States Patent
Van Eerd et al.

(10) Patent No.: US 9,263,003 B2
(45) Date of Patent: Feb. 16, 2016

(54) METHOD AND SYSTEM FOR DISPLAYING USING BUFFER SWAPPING

(75) Inventors: Peter Anthony Van Eerd, Guelph (CA); Richard Jeffrey Kehres, Waterloo (CA); Carl Edward Kilgour Pacey, Waterloo (CA)

(73) Assignee: Blackberry Limited, Waterloo (CA)

( * ) Notice: Subject to any disclaimer, the term of this patent is extended or adjusted under 35 U.S.C. 154(b) by 326 days.

(21) Appl. No.: 13/544,165

(22) Filed: Jul. 9, 2012

(65) Prior Publication Data

US 2013/0021354 A1 Jan. 24, 2013

Related U.S. Application Data

(60) Provisional application No. 61/509,238, filed on Jul. 19, 2011.

(51) Int. Cl.

| | |
|---|---|
| ***G09G 5/36*** | (2006.01) |
| ***G09G 5/399*** | (2006.01) |
| ***G09G 5/34*** | (2006.01) |
| *G09G 5/393* | (2006.01) |

(52) U.S. Cl.
CPC ..... *G09G 5/399* (2013.01); *G09G 5/346* (2013.01); *G09G 5/393* (2013.01); *G09G 2360/127* (2013.01)

(58) Field of Classification Search
CPC ..... G09G 5/393; G09G 5/399; G09G 5/395
USPC ..... 345/545, 539
See application file for complete search history.

(56) References Cited

U.S. PATENT DOCUMENTS

| | | | |
|---|---|---|---|
| 7,064,765 | B2 | 6/2006 | Hochmuther et al. |
| 7,756,207 | B2 | 7/2010 | Scholz et al. |
| 2003/0095125 | A1 | 5/2003 | Lim |
| 2003/0179208 | A1 | 9/2003 | Lavelle |
| 2004/0179019 | A1 | 9/2004 | Sabella |
| 2009/0058886 | A1 | 3/2009 | Tanaka |

OTHER PUBLICATIONS

Extended European Search Report for corresponding European Patent Application No. 12175494.9 dated Nov. 6, 2012.

*Primary Examiner* — Hau Nguyen
(74) *Attorney, Agent, or Firm* — Ridout & Maybee LLP

(57) ABSTRACT

Methods and systems which may implement buffer swapping are provided. The methods include rendering, onto screen locations of a display screen, data from a memory having a first buffer and a second buffer, each buffer having respective buffer memory locations which correspond to the screen locations of the display screen. The methods can include: rendering first data from the first buffer onto the display screen; writing, to the second buffer, second data based on at least some of the first data from the first buffer by performing at least one of transforming at least some first data and changing corresponding screen locations of at least some first data from the first buffer, by writing at most once to each buffer memory location of the second buffer; and rendering the second data from the second buffer onto the display screen.

23 Claims, 6 Drawing Sheets

METHOD AND SYSTEM FOR DISPLAYING USING BUFFER SWAPPING

CROSS REFERENCE TO RELATED APPLICATIONS

This application claims the benefit of U.S. Application No. 61/509,238, filed Jul. 19, 2011, the contents of which are herein incorporated by reference.

TECHNICAL FIELD

Example embodiments relate to the field of computer graphics, and more specifically to displaying onto a screen or display using buffer swapping.

BACKGROUND

In some buffering systems, two or more buffers may each be selectively designated for purposes of displaying onto a display screen. For example, one buffer may be designated as the front buffer which is actively being displayed by the display screen. The other buffer may be designated as the back buffer which is being drawn or rendered while the front buffer is being displayed. When a suitable trigger occurs such as drawing completion of the back buffer, or after a predetermined refresh interval, the roles of the two buffers may be switched or swapped, for example by modifying a pointer or address to the other buffer. In this instance, the original back buffer is now the front buffer and the original front buffer is now the back buffer. The new back buffer is now designated for rendering or drawing of a next graphic. This process may sometimes be referred to as buffer swapping, page flipping, ping-pong buffering, or generally as double buffering.

Another feature of some buffer swapping systems is to provide a copy-back or preserve function. In such a function, upon swapping, the new front buffer is automatically copied to the new back buffer. A difficulty with some buffer swapping systems is that each instance of buffer copying typically requires a full screen of pixels to be copied from one buffer to another buffer, which can require processor time commitments and may be wasteful on processor resources.

Other difficulties with existing systems may be appreciated in view of the detailed description herein below.

BRIEF DESCRIPTION OF THE DRAWINGS

Embodiments will now be described, by way of example only, with reference to the attached Figures, wherein.

Like reference numerals are used throughout the Figures to denote similar elements and features.

DETAILED DESCRIPTION OF EXAMPLE EMBODIMENTS

Figure 1:
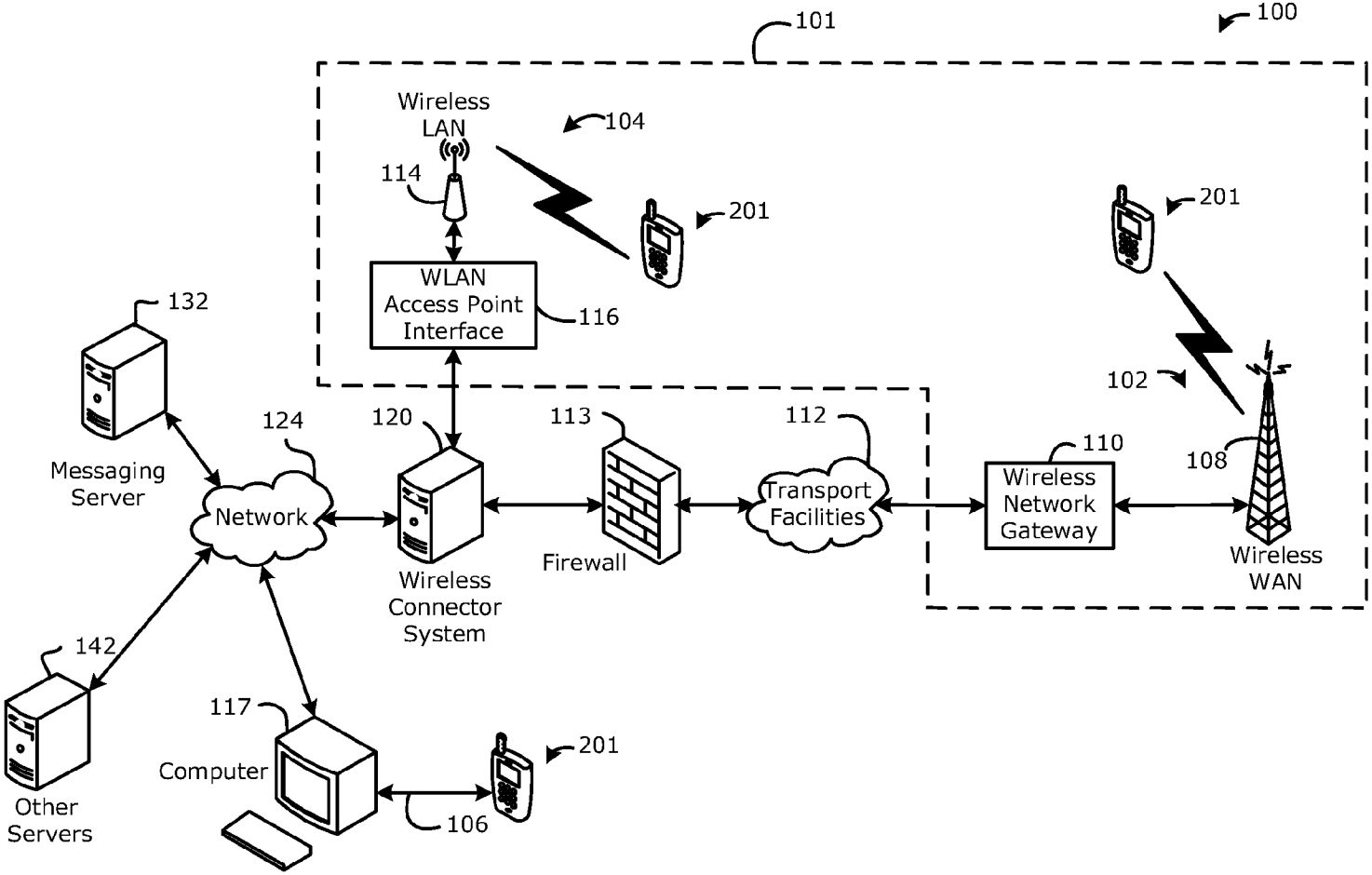
FIG. 1 is a block diagram of a communications system to which embodiments may be applied.

In accordance with an example embodiment, there is provided a method for rendering, onto screen locations of a display screen, data from a memory having a first buffer and a second buffer, each buffer having respective buffer memory locations which correspond to the screen locations of the display screen. The method includes: rendering first data from the first buffer onto the display screen; writing, to the second buffer, second data based on at least some of the first data by performing at least one of transforming at least some first data from the first buffer and changing corresponding screen locations of at least some first data from the first buffer, by writing at most once to each buffer memory location of the second buffer; and rendering the second data from the second buffer onto the display screen.

The method may further include, prior to said writing, receiving an instruction for changing what is displayed on the display screen.

In some example embodiments, the instruction is an instruction for transforming at least some first data.

In some example embodiments, the instruction includes a scroll instruction.

In some example embodiments, the writing comprises copying at least some first data, which corresponds to first screen locations, to respective memory locations of the second buffer which correspond to second screen locations different from said respective first screen locations.

In some example embodiments, the method further includes, prior to the receiving, refraining from writing to the second buffer until said instruction is received.

In some example embodiments, the writing includes obtaining some but not all of the first data from the first buffer.

In some example embodiments, the starting buffer memory location of the obtained first data is not the starting buffer memory location of the first buffer.

In some example embodiments, the writing includes writing to some but not all buffer memory locations of the second buffer.

In some example embodiments, the starting buffer memory location of the part of the second buffer written to is not the starting buffer memory location of the second buffer.

In accordance with another example embodiment, there is provided a computer device, which includes: a controller, a display screen having screen locations and coupled to the controller, memory accessible by the controller for storing a first buffer and a second buffer, each buffer having respective buffer memory locations which correspond to the screen locations of the display screen. The controller is configured to: render first data from the first buffer onto the display screen, write, to the second buffer, second data based on at least some of the first data by performing at least one of transforming at least some first data from the first buffer and changing corresponding screen locations of at least some first data from the first buffer, by writing at most once to each buffer memory location of the second buffer, and render the second data from the second buffer onto the display screen.

In accordance with another example embodiment, there is provided a method for rendering, onto screen locations of a display screen, data from a memory having a first buffer and a second buffer, each buffer having respective buffer memory locations which correspond to the screen locations of the display screen. The method includes: rendering first data from the first buffer onto the display screen; waiting for an instruction for changing what is displayed on the display screen; receiving the instruction; and based on the instruction, selectively writing, to the second buffer, second data based on at least some of the first data from the first buffer.

In accordance with yet another example embodiment, there is provided a non-transitory computer-readable medium tangibly embodying computer executable instructions for rendering data to a memory having a first buffer and a second buffer, the instructions comprising instructions for performing the methods described herein.

Reference is first made to FIG. 1 which shows in block diagram form a communication system 100 in which example embodiments can be applied. The communication system 100 comprises a number of mobile communication devices (mobile devices) 201 which may be connected to the remainder of system 100 in any of several different ways. Accordingly, several instances of mobile communication devices 201 are depicted in FIG. 1 employing different example ways of connecting to system 100. Mobile communication devices 201 are connected to a wireless communication network 101 which may comprise one or more of a Wireless Wide Area Network (WWAN) 102 and a Wireless Local Area Network (WLAN) 104 or other suitable network arrangements. In some embodiments, the mobile communication devices 201 are configured to communicate over both the WWAN 102 and WLAN 104, and to roam between these networks. In some embodiments, the wireless network 101 may comprise multiple WWANs 102 and WLANs 104.

The WWAN 102 may be implemented as any suitable wireless access network technology. By way of example, but not limitation, the WWAN 102 may be implemented as a wireless network that includes a number of transceiver base stations 108 (one of which is shown in FIG. 1) where each of the base stations 108 provides wireless Radio Frequency (RF) coverage to a corresponding area or cell. The WWAN 102 is typically operated by a mobile network service provider that provides subscription packages to users of the mobile communication devices 201. In some embodiments, the WWAN 102 conforms to one or more of the following wireless network types: Mobitex Radio Network, DataTAC, GSM (Global System for Mobile Communication), GPRS (General Packet Radio System), TDMA (Time Division Multiple Access), CDMA (Code Division Multiple Access), CDPD (Cellular Digital Packet Data), iDEN (integrated Digital Enhanced Network), EvDO (Evolution-Data Optimized) CDMA2000,, EDGE (Enhanced Data rates for GSM Evolution), UMTS (Universal Mobile Telecommunication Systems), HSDPA (High-Speed Downlink Packet Access), IEEE 802.16e (also referred to as Worldwide Interoperability for Microwave Access or "WiMAX), or various other networks. Although WWAN 102 is described as a "Wide-Area" network, that term is intended herein also to incorporate wireless Metropolitan Area Networks (WMAN) and other similar technologies for providing coordinated service wirelessly over an area larger than that covered by typical WLANs.

The WWAN 102 may further comprise a wireless network gateway 110 which connects the mobile communication devices 201 to transport facilities 112, and through the transport facilities 112 to a wireless connector system 120. Transport facilities may include one or more private networks or lines, the public internet, a virtual private network, or any other suitable network. The wireless connector system 120 may be operated, for example, by an organization or enterprise such as a corporation, university, or governmental department, which allows access to a network 124 such as an internal or enterprise network and its resources, or the wireless connector system 120 may be operated by a mobile network provider. In some embodiments, the network 124 may be realised using the internet rather than an internal or enterprise network.

The wireless network gateway 110 provides an interface between the wireless connector system 120 and the WWAN 102, which facilitates communication between the mobile communication devices 201 and other devices (not shown) connected, directly or indirectly, to the WWAN 102. Accordingly, communications sent via the mobile communication devices 201 are transported via the WWAN 102 and the wireless network gateway 110 through transport facilities 112 to the wireless connector system 120. Communications sent from the wireless connector system 120 are received by the wireless network gateway 110 and transported via the WWAN 102 to the mobile communication devices 201.

The WLAN 104 comprises a wireless network which, in some embodiments, conforms to IEEE 802.11x standards (sometimes referred to as Wi-Fi) such as, for example, the IEEE 802.11a, 802.11b and/or 802.11g standard. Other communication protocols may be used for the WLAN 104 in other embodiments such as, for example, IEEE 802.11n, IEEE 802.16e (also referred to as Worldwide Interoperability for Microwave Access or "WiMAX"), or IEEE 802.20, (also referred to as Mobile Wireless Broadband Access). The WLAN 104 includes one or more wireless RF Access Points (AP) 114 (one of which is shown in FIG. 1) that collectively provide a WLAN coverage area.

The WLAN 104 may be a personal network of the user, an enterprise network, or a hotspot offered by an internet service provider (ISP), a mobile network provider, or a property owner in a public or semi-public area, for example. The access points 114 are connected to an access point (AP) interface 116 which may connect to the wireless connector system 120 directly (for example, if the access point 114 is part of an enterprise WLAN 104 in which the wireless connector system 120 resides), or indirectly via the transport facilities 112 if the access point 14 is a personal Wi-Fi network or Wi-Fi hotspot (in which case a mechanism for securely connecting to the wireless connector system 120, such as a virtual private network (VPN), may be required). The AP interface 116 provides translation and routing services between the access points 114 and the wireless connector system 120 to facilitate communication, directly or indirectly, with the wireless connector system 120.

The wireless connector system 120 may be implemented as one or more servers, and is typically located behind a firewall 113. The wireless connector system 120 manages communications, including email messages, to and from a set of managed mobile communication devices 201. The wireless connector system 120 also provides administrative control and management capabilities over users and mobile communication devices 201 which may connect to the wireless connector system 120.

The wireless connector system 120 allows the mobile communication devices 201 to access the network 124 and connected resources and services such as a messaging server 132 (for example, a Microsoft Exchange™, IBM Lotus Domino™, or Novell GroupWise™ email messaging server) and optionally other servers 142. The other servers 142 may comprise a content server for providing content such as internet content or content from an organization's internal servers to the mobile communication devices 201 in the wireless network 101, an application server for implementing server-based applications such as instant messaging (IM) applications, or a web server for providing content accessible by a web browser.

The wireless connector system 120 typically provides a secure exchange of data (e.g., email messages, personal information manager (PIM) data, and IM data) with the mobile communication devices 201. In some embodiments, communications between the wireless connector system 120 and the mobile communication devices 201 are encrypted. In some embodiments, communications are encrypted using a symmetric encryption key implemented using Advanced Encryption Standard (AES) or Triple Data Encryption Standard (Triple DES) encryption. Private encryption keys are generated in a secure, two-way authenticated environment and are used for both encryption and decryption of data.

The wireless network gateway 110 is adapted to send data packets received from a mobile communication device 201 over the WWAN 102 to the wireless connector system 120. The wireless connector system 120 then sends the data packets to the appropriate connection point such as the messaging server 132, or other servers 142. Conversely, the wireless connector system 120 sends data packets received, for example, from the messaging server 132, or other servers 142 to the wireless network gateway 110 which then transmit the data packets to the destination mobile communication device 201. The AP interfaces 116 of the WLAN 104 provide similar sending functions between the mobile communication device 201, the wireless connector system 120 and network connection point such as the messaging server 132, or other servers 142.

The network 124 may comprise a private local area network, metropolitan area network, wide area network, the public internet or combinations thereof and may include virtual networks constructed using any of these, alone, or in combination.

A mobile communication device 201 may alternatively connect to the wireless connector system 120 using a computer 117, such as desktop or notebook computer, via the network 124. A link 106 may be provided for exchanging information between the mobile communication device 201 and computer 117 connected to the wireless connector system 120. The link 106 may comprise one or both of a physical interface and short-range wireless communication interface. The physical interface may comprise one or combinations of an Ethernet connection, Universal Serial Bus (USB) connection, Firewire™ (also known as an IEEE 1394, interface) connection, or other serial data connection, via respective ports or interfaces of the mobile communication device 201 and computer 117. The short-range wireless communication interface may be a personal area network (PAN) interface. A personal area network is a wireless point-to-point connection meaning no physical cables are required to connect the two end points. The short-range wireless communication interface may comprise one or a combination of an infrared (IR) connection such as an Infrared Data Association (IrDA) connection, a short-range radio frequency (RF) connection such as one specified by IEEE 802.15.1, or the Bluetooth™ special interest group, or IEEE 802.15.3a, also referred to as UltraWideband (UWB), or other PAN connection.

It will be appreciated that the above-described communication system is provided for the purpose of illustration only, and that the above-described communication system comprises one possible communication network configuration of a multitude of possible configurations for use with the mobile communication devices 201. The teachings of the present disclosure may be employed in connection with any other type of network and associated devices that are effective in implementing or facilitating wireless communication. Suitable variations of the communication system will be understood to a person of skill in the art and are intended to fall within the scope of the present disclosure.

Figure 2:
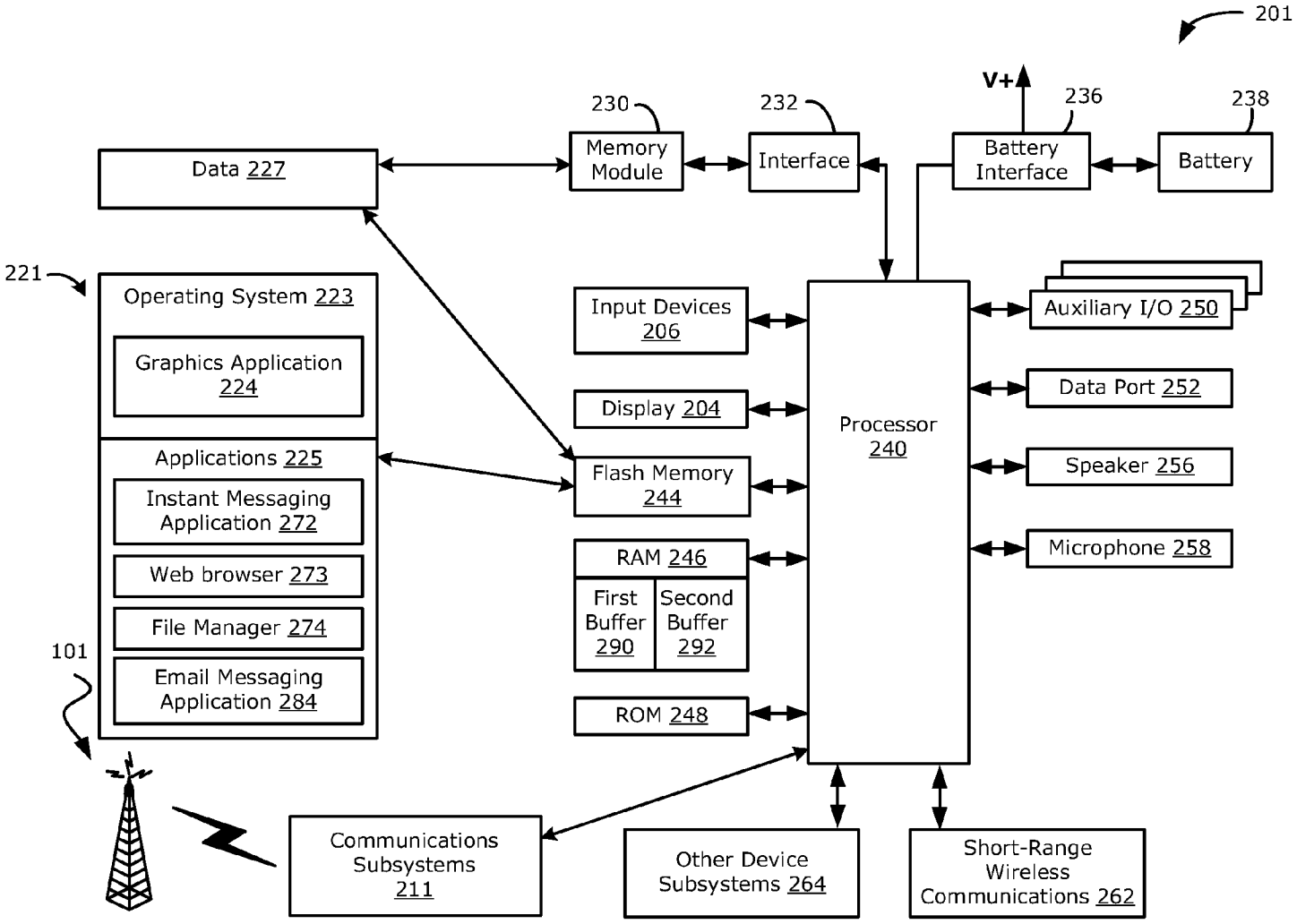
FIG. 2 is a block diagram showing an example embodiment of a mobile communication device that can be used in the communications system of FIG. 1.

Reference is now made to FIG. 2 which illustrates a mobile communication device 201 in which example embodiments described in the present disclosure may be applied. The mobile communication device 201 is a two-way communication device having data and optionally voice communication capabilities, and the capability to communicate with other computer systems, for example, via the Internet. Depending on the functionality provided by the mobile communication device 201, in various embodiments the device 201 may be a multiple-mode communication device configured for both data and voice communication, a smartphone, a mobile telephone or a PDA (personal digital assistant) enabled for wireless communication, or a computer system with a wireless modem.

The mobile communication device 201 includes a case (not shown) housing the components of the device 201. The internal components of the device 201 are constructed on a printed circuit board (PCB). The mobile device 201 includes a controller comprising at least one processor 240 (such as a microprocessor) which controls the overall operation of the device 201. The processor 240 interacts with device subsystems such as a wireless communication subsystem 211 for exchanging radio frequency signals with the wireless network 101 to perform communication functions. The processor 240 interacts with additional device subsystems including a display screen 204 such as a liquid crystal display (LCD) screen, input devices 206 such as a keyboard and control buttons, flash memory 244, random access memory (RAM) 246, read only memory (ROM) 248, auxiliary input/output (I/O) subsystems 250, data port 252 such as serial data port, such as a Universal Serial Bus (USB) data port, speaker 256, microphone 258, short-range communication subsystem 262, and other device subsystems generally designated as 264. Some of the subsystems shown in FIG. 2 perform communication-related functions, whereas other subsystems may provide "resident" or on-device functions.

The device 201 may comprise a touchscreen display in some embodiments. The touchscreen display may be constructed using a touch-sensitive input surface connected to an electronic controller and which overlays the display screen 204. The touch-sensitive overlay and the electronic controller provide a touch-sensitive input device and the processor 240 interacts with the touch-sensitive overlay via the electronic controller.

The mobile device 201 may communicate with any one of a plurality of fixed transceiver base stations 108 (FIG. 1) of the wireless network 101 within its geographic coverage area. The mobile device 201 may send and receive communication signals over the wireless network 101 after the required network registration or activation procedures have been completed.

The processor 240 operates under stored program control and executes software modules 221 stored in memory such as persistent memory, for example, in the flash memory 244. As illustrated in FIG. 2, the software modules 221 comprise operating system software 223 and software applications 225, which for example, may include a text or instant messaging application 272, a web browser 273, a file manager application 274, and an email messaging application 284. In some example embodiments, the functions performed by each of the applications 272, 273, 274, and 284 may each be realized as a plurality of independent elements, and any one or more of these elements may be implemented as parts of other software applications 225.

The software modules 221 or parts thereof may be temporarily loaded into volatile memory such as the RAM 246. The RAM 246 is used for storing runtime data variables and other types of data or information. Although specific functions are described for various types of memory, this is merely one example, and a different assignment of functions to types of memory could also be used.

In some embodiments, the auxiliary input/output (I/O) subsystems 250 may comprise an external communication link or interface, for example, an Ethernet connection. The mobile device 201 may comprise other wireless communication interfaces for communicating with other types of wireless networks, for example, a wireless network such as an orthogonal frequency division multiplexed (OFDM) network or a GPS (Global Positioning System) subsystem comprising a GPS transceiver for communicating with a GPS satellite network (not shown). The auxiliary I/O subsystems 250 may comprise a pointing or navigational tool (input device) such as a clickable trackball or scroll wheel or thumbwheel, or a vibrator for providing vibratory notifications in response to various events on the device 201 such as receipt of an electronic message or incoming phone call, or for other purposes such as haptic feedback (touch feedback).

In some embodiments, the mobile device 201 includes a removable memory card 230 (typically comprising flash memory) and a memory card interface 232. The mobile device 201 can store data 227 on the removable memory card 230, in an erasable persistent memory, which in one example embodiment is the flash memory 244, or on both a removable memory card and in an erasable persistent memory.

In various embodiments, the data 227 includes service data comprising information required by the mobile device 201 to establish and maintain communication with the wireless network 101. The data 227 may also include user application data such as email messages, address book and contact information, calendar and schedule information, word processor documents, spreadsheets, presentation slides, image files, audio and video files and other commonly stored user information stored on the mobile device 201 by its user, and other data. The data 227 stored in the persistent memory (e.g. flash memory 244) of the mobile device 201 may be organized, at least partially, into a number of databases each containing data items of the same data type or associated with the same application. For example, email messages, contact records, and task items may be stored in individual databases within the device memory.

In some embodiments, the mobile device 201 is provided with a service routing application programming interface (API) which provides an application with the ability to route traffic through a serial data (i.e., USB) or Bluetooth™ connection to the host computer system using standard connectivity protocols. When a user connects their mobile device 201 to the host computer system via a USB cable or Bluetooth™ connection, traffic that was destined for the wireless network 101 is automatically routed to the mobile device 201 using the USB cable or Bluetooth™ connection. Similarly, any traffic destined for the wireless network 101 is automatically sent over the USB cable Bluetooth™ connection to the host computer system for processing.

The mobile device 201 also includes a battery 238 as a power source, which is typically one or more rechargeable batteries that may be charged, for example, through charging circuitry coupled to a battery interface such as the serial data port 252. The battery 238 provides electrical power to at least some of the electrical circuitry in the mobile device 201, and the battery interface 236 provides a mechanical and electrical connection for the battery 238. The battery interface 236 is coupled to a regulator (not shown) which provides power V+ to the circuitry of the mobile device 201.

The short-range communication subsystem 262 is an additional optional component which provides for communication between the mobile device 201 and different systems or devices, which need not necessarily be similar devices. For example, the subsystem 262 may include an infrared device and associated circuits and components, or a wireless bus protocol compliant communication mechanism such as a Bluetooth™ communication module to provide for communication with similarly-enabled systems and devices.

A predetermined set of applications that control basic device operations, including data and possibly voice communication applications will normally be installed on the mobile device 201 during or after manufacture. Additional applications and/or upgrades to the operating system 223 or software applications 225 may also be loaded onto the mobile device 201 through the wireless network 101, the auxiliary I/O subsystem 250, the serial port 252, the short-range communication subsystem 262, or other suitable subsystem 264.

The downloaded programs or code modules may be permanently installed, for example, written into the program memory (i.e. the flash memory 244), or written into and executed from the RAM 246 for execution by the processor 240 at runtime. Such flexibility in application installation increases the functionality of the mobile device 201 and may provide enhanced on-device functions, communication-related functions, or both. For example, secure communication applications may enable electronic commerce functions and other such financial transactions to be performed using the mobile device 201.

The mobile device 201 may provide two principal modes of communication: a data communication mode and an optional voice communication mode. In the data communication mode, a received data signal such as a text message, an email message, or Web page download will be processed by the communication subsystem 211 and input to the processor 240 for further processing. For example, a downloaded Web page may be further processed by a browser application or an email message may be processed by the email messaging application and output to the display screen 204. A user of the mobile device 201 may also compose data items, such as email messages, for example, using the input devices in conjunction with the display screen 204. These composed items may be transmitted through the communication subsystem 211 over the wireless network 101.

In the voice communication mode, the mobile device 201 provides telephony functions and operates as a typical cellular phone. The overall operation is similar, except that the received signals would be output to the speaker 256 and signals for transmission would be generated by a transducer such as the microphone 258. The telephony functions are provided by a combination of software/firmware (i.e., the voice communication module) and hardware (i.e., the microphone 258, the speaker 256 and input devices).

Alternative voice or audio I/O subsystems, such as a voice message recording subsystem, may also be implemented on the mobile device 201. Although voice or audio signal output is typically accomplished primarily through the speaker 256, the display screen 204 may also be used to provide an indication of the identity of a calling party, duration of a voice call, or other voice call related information.

Reference is again made to FIG. 2, which shows a graphics application module 224 as a component of the operating system 223. In some example embodiments, the graphics application module 224 may perform display functions for the device 201, and may act as an interface between a particular application 225, the RAM 246, and/or the display screen 204, for rending data for display onto the display screen 204.

While illustrated as a part of the operating system 223 in FIG. 2, in other examples, the graphics application module 224 may be a separate application that is separate from the operating system 223. A particular application 225 may also include or perform the functions of the graphics application module 224, for example some media or gaming applications. Further, the graphics application module 224 may be implemented by other operating system components, other applications 225, or any combination or sub-combination thereof.

Referring still to FIG. 2, for purposes of double buffering or buffer swapping, the RAM 246 may include a first buffer 290 and a second buffer 292 which may each be used for write to and read out of (render) data. The first buffer 290 has respective buffer memory locations which correspond to screen locations (e.g. displayed pixels) of the display screen 204. The second buffer 292 has respective buffer memory locations which correspond to the screen locations of the display screen 204. For example, the display screen 204, either directly or via an intermediary interface or module (not shown), may read out from one of the buffers 290, 292, generally designated as a front buffer, for example using a first pointer or starting address. Similarly, the other of the buffers 290, 292 may be written to by the graphics application module 224 or other application, generally designated as a back buffer, for example using a second pointer or starting address. These buffers 290, 292 may also sometimes be referred to as surface buffers or swap buffers.

To generally implement buffer swapping, the one of the buffer 290 or 292 which receives data from the graphics application module 224 (or other rendering module) may be designated as the back buffer, while the other buffer 290 or 292 being read by (rendered to) the display screen 204 or suitable interface may be designated as the front buffer. The graphics application module 224 generally continues writing to the back buffer, and the display screen 204 is maintained until a buffer swap occurs (e.g. a buffer swap instruction or function). When a buffer swap occurs, the graphics application module 224 and the display screen 204 swap which of the buffers 290 and 292 are being accessed by the graphics application module 224 and the display screen 204, typically by way of modifying or switching the respective pointers or addresses.

For example, presume that the first buffer 290 is currently the back buffer and that the graphics application module 224 is writing to the first buffer 290. In such an example, the second buffer 292 is currently the front buffer and is being read by (rendered to) the display screen 204. In response to a buffer swap, the graphics application module 224 may generally write data to the second buffer 292, which is now the "back buffer", instead of writing to the first buffer 290. Furthermore, the display 224 begins to read graphical data from the first buffer 290, which is now the "front buffer", instead of reading from the second buffer 292.

Upon the occurrence of the next buffer swap, the graphics application module 224 may write data to the first buffer 290, which is again considered to be the "back buffer", and the display 224 begins to read graphical data from the second buffer 292, which is again considered to be the "front buffer".

In some example embodiments, the first buffer 290 and the second buffer 292 are frame buffers for writing and reading of "data frames", for example to render two dimensional text or graphical data. In some example embodiments, the first buffer 290 and the second buffer 292 have the same dimensions so that buffer swapping may be readily performed, for example by having a pointer or starting address to the selected buffer.

A difficulty with some conventional buffer swapping systems is that, upon swapping, a copy-back is automatically performed wherein the new front buffer is automatically copied to the new back buffer. In doing so, the processor 240 may be required to wait for this copying to complete before starting the next writing onto the back buffer. Further, the processor 240 resources may be spent on copying rather than performing other functions such as receiving a next instruction or input for rendering the next data or data frame.

This difficulty may occur, for example, when performing a transformation such as scrolling. For example, a common graphics task for mobile device applications is to scroll the information being displayed. For example, text and graphics may be scrolled from, e.g., an e-mail message or web page, onto the display 224, and these items would be displayed to the user as being drawn slightly higher or lower from one frame to the next, to have the items scroll up or down on the display. In some conventional systems, in order to perform scrolling, unnecessary buffer copies may be made to the back buffer, for example one buffer copy on the copy-back for the preserve behaviour, and another buffer copy for the scroll behaviour.

In some example embodiments, there is generally provided what is referred to herein as "scroll copy-back". Using the data from the front buffer, the data changes corresponding screen locations by writing to the back buffer based on data from the front buffer, wherein the copied data is a transformed or scrolled version of the front buffer. In some example embodiments, it may be appreciated that only a single buffer copy may be required to be made to the back buffer, by writing at most once to each buffer memory location of the back buffer.

In some other example embodiments, there is generally provided a method wherein upon buffer swapping, the next instruction is received or retrieved and, depending on the instruction, copy-back of at least some of the pixels, regions or data may be selectively performed. It may be determined that the instruction relates to changing what is displayed on the display screen 204. For example, based on the received instruction, it may be determined that conventional copy-back be performed in some instances, and a selective copy-back such as scroll copy-back be performed in other instances, depending on the particular instruction. Selectively performing may include selectively writing to at least some memory locations of the back buffer based on at least some of the data obtained from the front buffer. In some example embodiments, any automatic buffer copy-back may be refrained from occurring until receiving the instruction. In another example, selectively performing copy-back may include not performing copy-back at all, for example when an end instruction is received.

In some example embodiments, Embedded-System Graphics Library (EGL™), may be used to perform at least some of the described processes. EGL generally handles graphics context management, surface/buffer binding, and rendering synchronization for enabling and enables high-performance, accelerated, mixed-mode 2D and 3D rendering using other Application Programming Interfaces (APIs). In some example embodiments, EGL may be programmed as to whether any copy-back or preserve function of the back buffer be "blank", in other words copy-back may be refrained from occurring.

Figure 3:
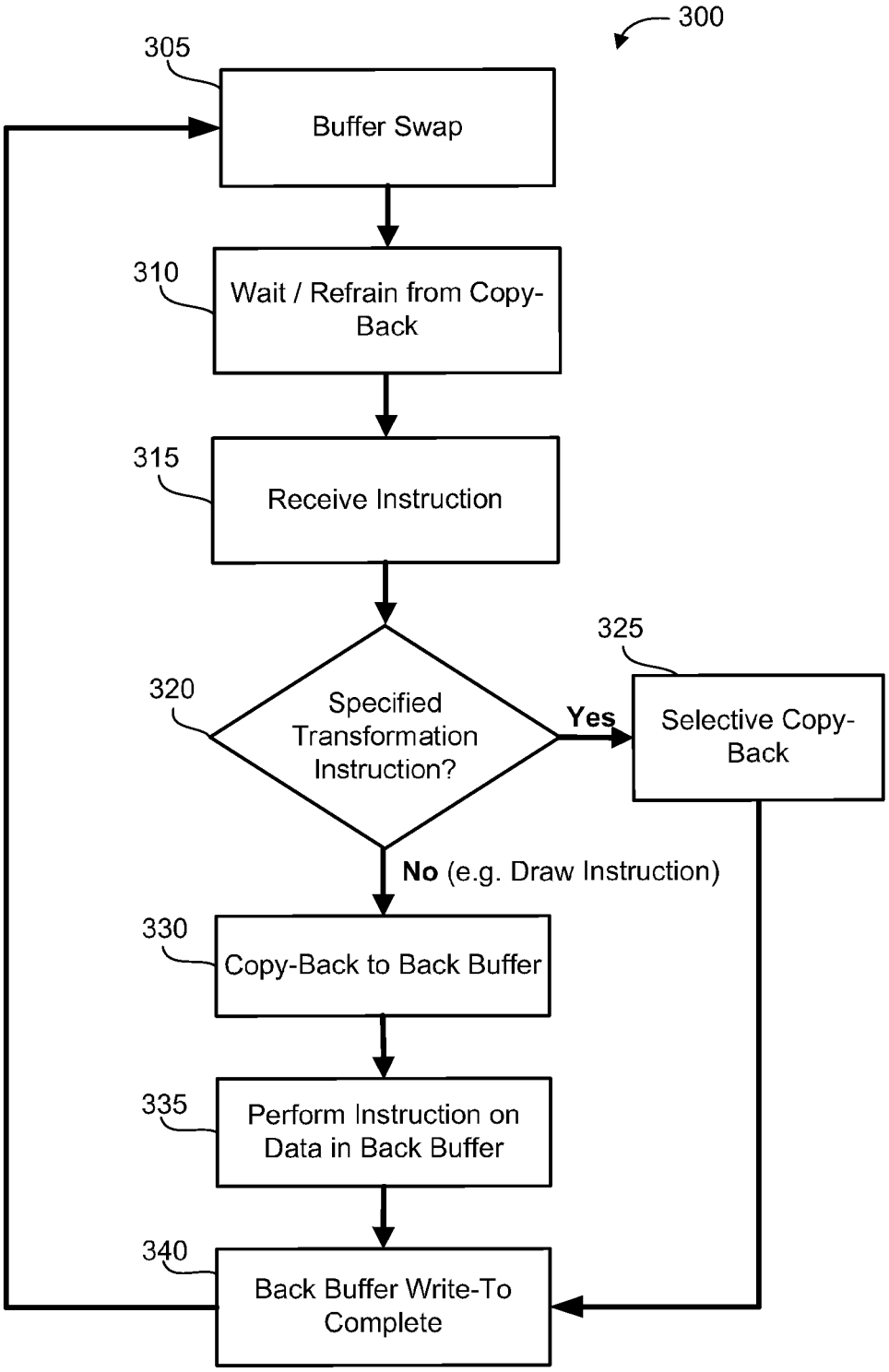
FIG. 3 shows, in flowchart form, an example method for rendering, onto a display screen, data from double buffers for display on a computer device in accordance with an example embodiment.

Reference is now made to FIG. 3, which shows, in flowchart form, a method 300 of rendering data, onto screen locations of the display screen 204, data from the first buffer 290 and the second buffer 292. As described above, the device 201 may have access to a memory such as RAM 246 which stores the first buffer 290 and the second buffer 292. One of the buffers 290, 292 may be designated as the front buffer while the other of the buffers 290, 292 may be designated as the back buffer. Generally, the method may continually operate in a loop, as shown. In alternate embodiments, other processes such as state-based processes may be performed instead, as appropriate. At least some of the method 300 may be performed by the graphics application module 224 to write data to the buffers 290, 292.

At event 305, the method 300 performs a "buffer swap". For example, this may include designating the first buffer 290 as the front buffer and the second buffer 292 as the back buffer. First data (e.g. a data frame) is contained in the first buffer 290. The buffer swap generally includes the first data from the first buffer 290 being read from and displayed onto the display screen 204. This buffer swap of event 305 may be performed when a suitable interval or trigger occurs such as drawing completion onto the back buffer, waiting for a next refresh interval, performing an update, or based on a synchronization with the display screen 204.

At event 310, after the buffer swap, the device 201 may refrain from performing copy-back (sometimes referred to as a preserve function or a reinstate function) of the first data from the first buffer 290 to the second buffer 292. Accordingly, in some example embodiments, the second buffer 292 may be "blank" at this stage, for example may be all black or all white. In other embodiments may retain data stored from a previous data frame. In some example embodiments, at event 310 this may be an active waiting step performed by the device 201. In other example embodiments, the graphics application module 224 is readily available to receive a next instruction in relation to rendering the next image or data frame into the back buffer (e.g., second buffer 292). In some example embodiments, the graphics application module 224 may actively pull or retrieve the next instruction.

At event 315, the graphics application module 224 receives a next instruction. The instruction may be in relation to changing what is displayed on the display screen 204, which may include manipulating at least some of the existing data or images contained in the displayed front buffer 290, 292. In some example embodiments, event 315 may also include the graphics application module 224 generating its own next instruction.

For ease of illustration, example instructions to change what is displayed on the display screen include but may not be limited to a draw instruction and a transformation instruction. The draw instruction results in rendering or drawing of a new text or graphic onto the display screen 204. The transformation instruction can be, e.g., a scroll instruction which results in what appears on the screen locations as the existing text or graphic being translated to a slightly higher or lower position (and/or left or right position, as appropriate). For example, vertical scrolling may be a result of using a scrollwheel attached to the device 201 or from a mouse. Horizontal scrolling may be a result of a panning instruction, for example from a scrollball or other input device. Diagonal scrolling may be a combination of both vertical scrolling and horizontal scrolling. The particular instruction in relation to rendering the next data frame may be received from an application 225 for processing by the graphics application module 224.

At event 320, it is determined whether the instruction includes a specified transformation instruction. The transformation instruction can be in relation to modifying or affecting one, some, or all of the data or objects contained in the first buffer 290 (e.g. one, some, or all images in the data frame may be affected). For example, if the transformation instruction is a scroll instruction, the method proceeds to event 325 and performs a selective copy-back, in this example, what is referred to herein as "scroll copy-back". In some example embodiments, scroll copy-back includes selective writing, to the second buffer 292, second data based on the first data by changing corresponding screen locations of at least some of the first data. The second data is displayed as a transformed or scrolled (e.g. shifted) version of the first data. In some example embodiments, scroll copy-back is achieved by writing at most once to each buffer memory location of the second buffer 292, so that only a single buffer copy may be required to be made to the second buffer 292. For example, this may contrast with some existing systems that may require two or more buffer copies. Additional transformations may also be performed on at least some of the first data when writing to the second buffer 292, still by writing at most once to each buffer memory location of the second buffer 292.

An example implementation of scroll copy-back may be used to vertically scroll by ten (10) pixels. For example, this may include copying from a non-zero starting address (e.g. a shifted origin) from the data in the front buffer 290 to the second buffer 292. An example implementation in C/C++ may be as follows (an example definition of the variables is described in greater detail herein below):

```
copyPixels(surface.buffer[surface.current], src, 0,0, 0, 10, 640, 470).
```

Accordingly, in accordance with some example embodiments, the scroll copy-back may be implemented in a single process, step or command. In the above example implementation, the starting buffer memory location of the part of the second buffer 292 written to is not the starting buffer memory location of the second buffer 292. In some example implementation, some but not all of the data from the second buffer 292 is written to.

In some other example embodiments, some but not all of the pixels or regions or data are copied or obtained from the first buffer 290 during scroll copy-back. For example, if the command is to vertically scroll by ten (10) pixels, then the contents of the first buffer 290 (Buffer A) may be copied excluding the region within the uppermost 10, pixels, which are no longer of interest. In some of such example embodiments, the starting buffer memory location of the obtained data of the first buffer 290 is not the starting buffer memory location of the first buffer 290. In some example implementation, some but not all of the data from the first buffer 290 is copied.

At event 340, the drawing to the second buffer 292 is now completed, and the method 300 may loop back to event 305 to perform a next buffer swap. For example, second buffer 292 is now designated as the front buffer and the first buffer 290 is designated as the back buffer. The data contained in the second buffer 292 may be rendered to the display screen 204. The method 300 may be repeated as appropriate.

Referring again to event 320, if it is determined that the instruction is not a specified transformation instruction, then conventional buffer copy-back may be performed, as shown in event 330. In other words, the first data from the first buffer 290 is copied to the second buffer 292. At event 335, the particularly received instruction is performed onto the second buffer 292.

Referring again to event 330, in some alternate example embodiments, selective buffer copy-back occurs to copy only a region of interest, specified pixels, or at least some data from the first buffer 290 into the second buffer 292. For example, in some example embodiments only the pixels, regions, or data that have changed are copied back. Such examples may, for example, apply when the second buffer 292 has retained data from a previous data frame, and may include determining which pixels, regions, or data have changed. Note that copying particular pixels, regions, or data of interest may not be limited to rectangular regions but could be irregular shapes such as the shape of an image or graphic.

Referring again to event 330, in some other example embodiments, selective buffer copy-back occurs to copy some but not all of the pixels or regions or data from the first buffer 290. For example, this may be performed when the second buffer 292 has retained data from a previous data frame (not shown here).For example, referring again to event 320, if the instruction is a draw instruction, then copying may be performed at event 330 to copy at least some of the first data from the first buffer 290 to the second buffer 292. At event 335, the draw instruction is performed onto a particular region of interest of the data contained in the second buffer 292. It may be appreciated that only the pixels affected by the draw instruction may be drawn or rendered over, while the existing copy from the first buffer 290 is retained. Once this is completed, the method 300 proceeds to event 340, which is the drawing or rendering to the second buffer 292 being completed.

In some example embodiments, at event 315 the instruction being received is an end instruction or a stop instruction (not shown). In such an embodiment, the method 300 may then end or stop after event 315 (not shown). Accordingly, it would be appreciated that unnecessary buffer copy-back would not be performed in such example embodiments. For example, zero buffer copies would be required in such an instance.

Figure 4:
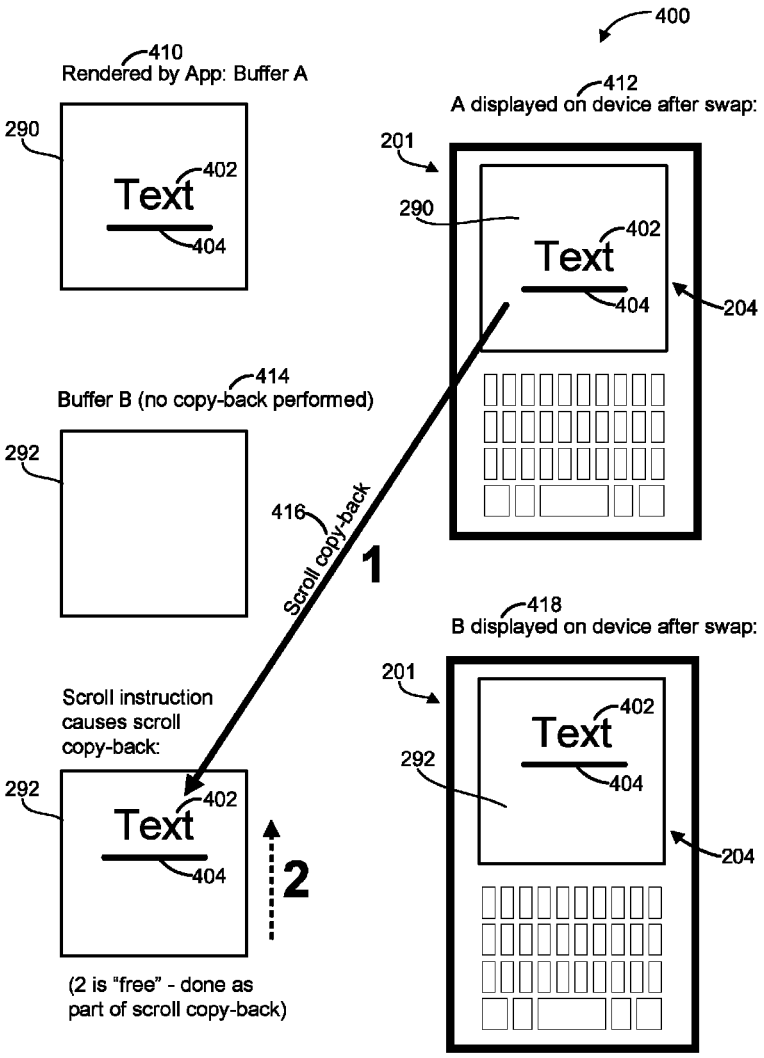
FIG. 4 shows, in diagrammatic form, an illustrative representation of a rendering process as applied a computer device for implementing a scroll instruction, in accordance with an example embodiment.

Reference is now made to FIG. 4, which illustrates a rendering process 400 as applied to the buffers 290, 292 for implementing a scroll instruction, in accordance with an example embodiment. For convenience of reference, as shown, the first buffer 290 may be referred to as "Buffer A" while the second buffer 292 may be referred to as "Buffer B". As shown at event 410, Buffer A may start with having data stored thereon for rendering to the display screen 204, in this example black text ("Text") 402 and/or a black line 404.

At event 412, the device 201 may start by performing a "buffer swap". For example, the first buffer 290 (Buffer A) is designated as the front buffer and the second buffer 292 (Buffer B) as the back buffer. The data contained in Buffer A, e.g. the Text 402 and the black line 404, are directly read from and displayed onto the display screen 204. At event 414, after the buffer swap, the device 201 may refrain from performing copy-back of the data contained in Buffer A. Accordingly, the second buffer 292 may be "blank" at this stage, for example all white as shown. In other embodiments the second buffer 292 may retain data stored from a previous data frame.

Next, the device 201 receives or processes a next instruction. The instruction may be in relation to the next data frame, which may include manipulating at least some of the existing data contained in one of the buffers 290, 292. In the example shown, it is determined that the instruction includes a scroll instruction, to scroll the existing graphics upwards. Upon this determination, at event 416, the device 201 proceeds to perform "scroll copy-back". As shown, such a process includes performing the scrolling screen locations of the data 402, 404 from the first buffer 290 (Buffer A) upwardly as part of copying to the second buffer 292 (Buffer B), in order to perform the scroll copy-back. This will permit the appropriate pixels to be rendered to the second buffer 292 (Buffer B). For example, any off-screen pixels resulting from the scroll may not be rendered to the second buffer 292. In some example embodiments, it may be appreciated that only a single buffer copy may be required to be made to the second buffer 292, wherein each buffer memory location of the second buffer 292 is written to at most once. Similarly, any newly required pixels (at the bottom in this example) may be filled in using off-screen pixels (e.g. from a larger source image or buffer, not shown) or using filler pixels (e.g. white or black pixels).

At this stage, the drawing or rendering to the second buffer 292 (Buffer B) is now completed, and the device 201 is now available to perform a next buffer swap, shown as event 418. For the buffer swap, second buffer 292 (Buffer B) is now designated as the front buffer and displayed on the display screen 204, as shown. The first buffer 290 (Buffer A) is now designated as the back buffer, and can now be drawn onto.

Figure 5:
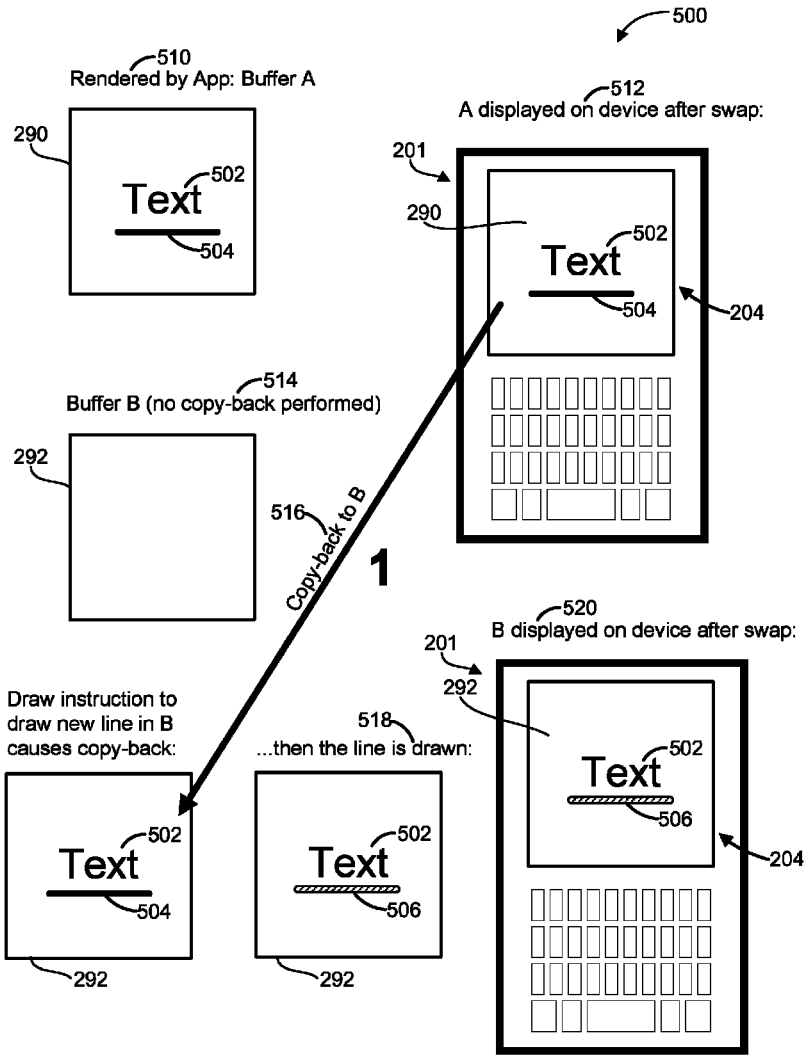
FIG. 5 shows, in diagrammatic form, another illustrative representation of a rendering process as applied to a computer device for implementing a draw instruction, in accordance with an example embodiment.

Reference is now made to FIG. 5, which illustrates a rendering process as applied to the buffers 290, 292 for implementing a draw instruction, in accordance with an example embodiment. For convenience of reference, as shown, the first buffer 290 may be referred to as "Buffer A" while the second buffer 292 may be referred to as "Buffer B". As shown at event 510, Buffer A may start with having data rendered thereon for display, in this example black text ("Text") 502 and/or a black line 504.

At event 512, the device 201 may start by performing a "buffer swap". For example, the first buffer 290 (Buffer A) is designated as the front buffer and the second buffer 292 (Buffer B) as the back buffer. The data contained in Buffer A, e.g. the Text 502 and the black line 504, are directly read from and displayed onto the display screen 204. At event 514, after the buffer swap, the device 201 may refrain from performing copy-back of the data contained in Buffer A. Accordingly, the second buffer 292 may be "blank" at this stage, for example all white as shown. In other embodiments, the second buffer 292 may retain data stored from a previous data frame.

Next, the device 201 receives or processes the next instruction which affects what is displayed on the display screen 204. The instruction may be in relation to a draw instruction, for example drawing a gray line which is overlaying the position of the black line 504. In the example shown, it is determined that the instruction does not include a specified transformation instruction such as a scroll instruction. Upon this determination, at event 516, the device 201 proceeds to perform conventional "copy-back" of the first buffer 290 (Buffer A). This may include a one-to-one copying of the pixels from the first buffer 290 (Buffer A) to the second buffer 292 (Buffer B). After the copy-back is performed, at event 518 a gray line 506 is rendered or drawn onto the second buffer 292 (Buffer B). Only those pixels in relation to the gray line 506 may require replacing within the second buffer 292 (Buffer B).

Note that, referring again to event 516, in some alternate example embodiments, some but not all of the pixels or regions or data are copied from the first buffer 290. For example, this may be performed when the second buffer 292 has retained data from a previous data frame (not shown here). Such an example would require at most one buffer copy.

Referring again to event 516, in some alternate example embodiments, some but not all of the pixels or regions or data are copied from the first buffer 290, for example copying of the entire contents of the first buffer 290 (Buffer A) excluding one or more regions of interest which may be the subject of the draw command. Such an example would require at most one buffer copy.

At this stage, the drawing or rendering to the second buffer 292 (Buffer B) is now completed, and the device 201 is now available to perform a next buffer swap, shown as event 520.

For the buffer swap, second buffer 292 (Buffer B) is now designated as the front buffer and rendered to the display screen 204, as shown. The first buffer 290 (Buffer A) is now designated as the back buffer, and can now be written to.

An example implementation of the rendering process of FIGS. 4 and 5 will now be described. An example implementation in C/C++ and using EGL may be as follows. Although some processes may be described in code and/or pseudo-code, it would be appreciated that a skilled person in the art would readily understand such processes and implementation thereof.

In some example embodiments, note that a "surface" typically holds two buffers, one that is being displayed, the other that is currently being drawn to (e.g., the first buffer 290 and the second buffer 292). These may be in an array, surface-.buffers[]. Which one is 'current' (i.e., drawn to when drawing functions are called) is controlled by surface.current, which is either 0, or 1. So surface.buffers[surface.current] is, at any time, either surface.buffers[0], or surface.buffers[1].

In order to implement the process of FIG. 4, including the scroll copy-back instruction, the following example implementation may be used.

```
step 1 - client code draws some text:
   drawText(surface, "Text", 10, 100); // i.e., some function that draws
into surface buffer
  drawLine(surface, 10, 140, 100, 140, BLACK);
   eglSwapBuffer(display, surface);
** implementation of eglSwapBuffer - using **** scroll copy-back code
      giveBufferToHardware(surface.buffer[surface.current]);
      // now new drawing operations will happen on the other buffer:
       surface.current = !surface.current; // if it was 1, now it is 0, and
vice-versa
       // **** note that we haven't done the copy-back yet ****
       surface.copyBackPending = true;
       // now "ready" for client to draw onto the surface:
       return;
step 2 - client decides to move text up 10 pixel-lines:
   scrollVertical(surface, 0, 10);
**   implementation of scrollVertical using scroll copy-back:
      if (surface.copyBackPending)
            // copy from old buffer, still on display
            src = surface.buffer[!surface.current]; // not the current buffer!
       else
            src = surface.buffer[surface.current]; // yes, from the current
buffer
       copyPixels(surface.buffer[surface.current], src, 0,0,0, 10, 640, 470);
   // ** COPY **
...finish on client side
  // fill in the exposed blank at the bottom:
  fillPixels(surface, 0,470,640,10, WHITE); // Can fill in off-screen pixels
instead of WHITE
  eglSwapBuffers(display, surface);
//NOTE: cost = 1 copy. (versus 2 copies the conventional way)
```

In order to implement the process of FIG. 5, including the drawing instruction, the following implementation maybe used:

```
step 1 - client code draws some text
   drawText(surface, "Text", 10, 100);
   drawLine(surface, 10, 140, 100, 140, BLACK);
   eglSwapBuffer(display, surface);
** implementation of eglSwapBuffer - using scroll copy-back code
      giveBufferToHardware(surface.buffer[surface.current]);
      // now new drawing operations will happen on the other buffer:
       surface.current = !surface.current; // if it was 1, now it is 0, and
vice-versa
      // **** note that we haven't done the copy-back yet ****
      surface.copyBackPending = true;
      // now "ready" for client to draw onto the surface:
      return;
```

-continued

```
step 2 - client code draws something new:
  // since we are using preserve, text is still there in the surface,
  // but let's redraw the line in gray:
  drawLine(surface, 10, 140, 100, 140, GRAY);
** implementation of drawLine( ) - using scroll copy-back
      // **** in drawLine( ) we need to check copyBackPending:
       if (surface.copyBackPending)
            copyPixels(surface.buffer[surface.current],
surface.buffer[!surface.current]); // ** COPY **
            surface.copyBackPending = false;
      now draw the line (how it is normally done)...
...client code continues:
  eglSwapBuffer(display, surface);
  ...
//NOTE: cost = 1 copy
```

Figure 6:
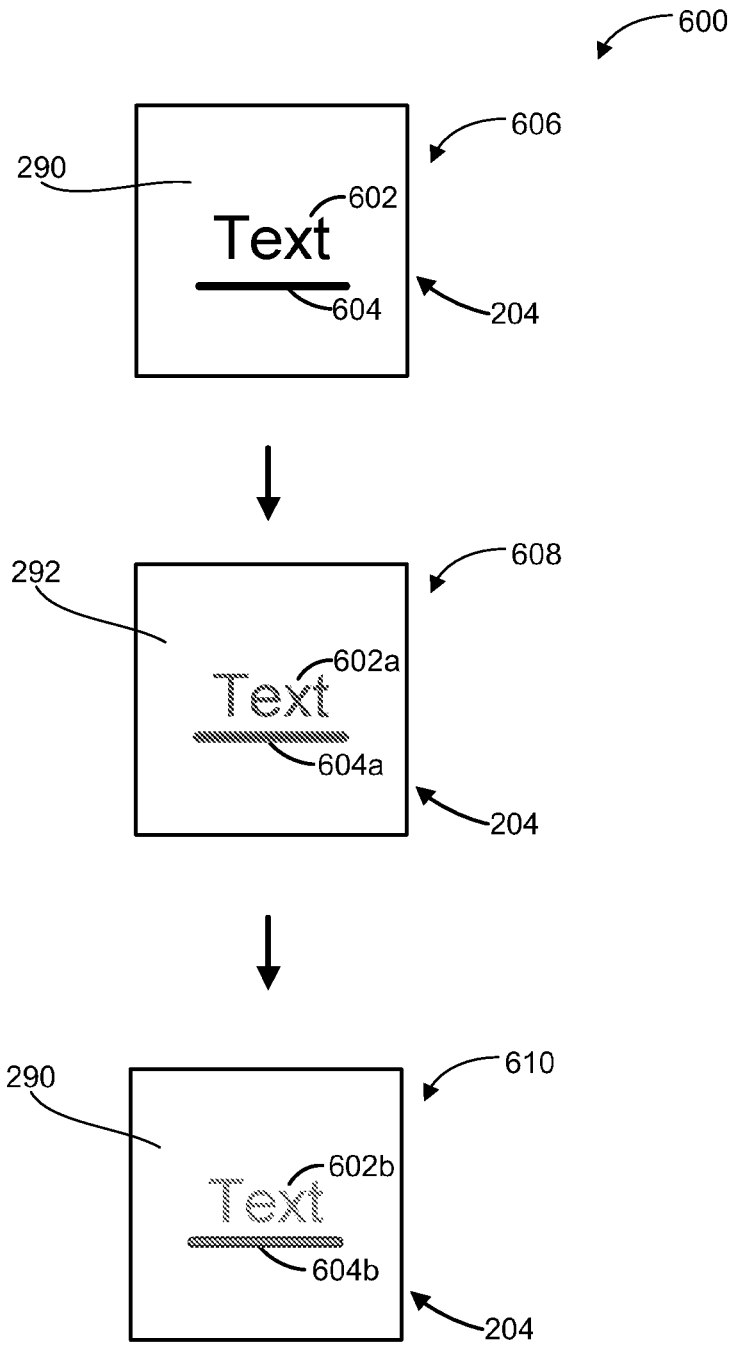
FIG. 6 shows, in diagrammatic form, another illustrative representation of a rendering process as applied to a computer device for implementing a transformation instruction, in accordance with an example embodiment.

Reference is now made to FIG. 6, which illustrates a rendering process 600 as applied to the buffers 290, 292 for implementing a transformation instruction, such as a fading or fade-to-black/fade-to-white instruction. As shown at step 606, the first buffer 290 may start with having data rendered thereon for display, in this example black text ("Text") 602 and/or a black line 604. The device 201 may then receive an instruction for changing what is displayed on the display screen 204, in this example a transformation instruction, such as a fading instruction. In response, the device 201 performs writing, to the second buffer 292, second data by transforming at least some first data from the first buffer 290, and by writing at most once to each buffer memory location of the second buffer 292. This is illustrated as text 602*a*, and line 604*a*, which are transformed to be grayer or lighter based from the text 602 and line 604 of the first buffer 290. Thus, at step 608, the device 201 renders the second data from the second buffer 292 onto the display screen 204.

At step 610, the device 201 may then receive a further instruction for performing the fading instruction. In response, the device 201 performs writing, to the first buffer 290, data by transforming at least some of the data from the second buffer 292, by writing at most once to each buffer memory location of the first buffer 290. This is illustrated as text 602*b*, and line 604*b* which are transformed to be grayer or lighter based from the text 602*a*, and line 604*a*, of the first buffer 292 (step 608). Thus, at step 610, the device 201 renders the first buffer 290 onto the display screen 204.

Other example transformation instructions and transformations include, without limitation, color change of some or all of the objects from the front buffer.

It can be appreciated that example embodiments may be implemented by any number of methods or programming constructs, including but not limited to EGL for OpenGL ES or OpenVG.

It can be appreciated that references herein to scrolling may include vertical scrolling, horizontal panning, a combination of both, or other such displacements such as z-direction scrolling for 3-D applications.

In some example embodiments, each of the buffers may be implemented as frame buffers (X×Y) to render a two-dimensional image onto the display. However, in some example embodiments more than two dimensions may be implemented (e.g. three-dimensions, X×Y×Z). In some example embodiments, more than two frame buffers may be suitably implemented for buffer swapping in a rotating display sequence in a similar fashion, as would be understood in the art.

The various described example embodiments have included the graphics application module 224 as being implemented by the processor 240. However, in some alternate example embodiments, the graphics application module 224 is at least partly performed by a separate graphics adapter (not shown) such as a graphics card. As would be understood in the art, the graphics adapter (not shown) may include its own processor, memory or RAM for storage of the buffers, and/or suitable interfaces for interfacing with the display and for receiving rendering instructions. In some example embodiments, as would be appreciated by those skilled in the art, the buffers may be stored in DRAM, VRAM, persistent memory such as flash memory 244, or other suitable memory.

It would be appreciated that, in some example embodiments, reduced processes or functions may be performed by determining whether the received instruction includes steps which can be combined into a single step, and selectively writing at most once to each buffer memory location of the second buffer to perform the instruction.

While some of the present embodiments are described in terms of methods, a person of ordinary skill in the art will understand that present embodiments are also directed to various apparatus such as a handheld electronic device including components for performing at least some of the aspects and features of the described methods, be it by way of hardware components, software or any combination of the two, or in any other manner. Moreover, an article of manufacture for use with the apparatus, such as a pre-recorded storage device or other similar computer readable medium including program instructions recorded thereon, or a computer data signal carrying computer readable program instructions may direct an apparatus to facilitate the practice of the described methods. It is understood that such apparatus, articles of manufacture, and computer data signals also come within the scope of the present example embodiments.

The term "computer readable medium" as used herein includes any medium which can store instructions, program steps, or the like, for use by or execution by a computer or other computing device including, but not limited to: magnetic media, such as a diskette, a disk drive, a magnetic drum, a magneto-optical disk, a magnetic tape, a magnetic core memory, or the like; electronic storage, such as a random access memory (RAM) of any type including static RAM, dynamic RAM, synchronous dynamic RAM (SDRAM), a read-only memory (ROM), a programmable-read-only memory of any type including PROM, EPROM, EEPROM, FLASH, EAROM, a so-called "solid state disk", other electronic storage of any type including a charge-coupled device (CCD), or magnetic bubble memory, a portable electronic data-carrying card of any type including COMPACT FLASH, SECURE DIGITAL (SD-CARD), MEMORY STICK, and the like; and optical media such as a Compact Disc (CD), Digital Versatile Disc (DVD) or BLU-RAY Disc.

Variations may be made to some example embodiments, which may include combinations and sub-combinations of any of the above. The various embodiments presented above are merely examples and are in no way meant to limit the scope of this disclosure. Variations of the innovations described herein will be apparent to persons of ordinary skill in the art having the benefit of the present disclosure, such variations being within the intended scope of the present disclosure. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present disclosure as a whole. The subject matter described herein intends to cover and embrace all suitable changes in technology.

The invention claimed is:

1. A method for rendering, onto screen locations of a display screen, data from a memory having a first buffer and a second buffer, each buffer having distinct respective buffer memory locations which correspond to the screen locations of the display screen, the method comprising:

rendering first data from the first buffer onto the display screen;

retaining previous data in the second buffer;

receiving an instruction for changing what is displayed on the display screen;

when the instruction includes a specified type of transforming, writing, to the second buffer, second data based on at least some of the first data by changing corresponding screen locations of at least some first data from the first buffer, by block copying said at least some first data, which corresponds to first screen locations, to respective memory locations of the second buffer which correspond to second screen locations different from said respective first screen locations, by writing at most once to each buffer memory location of the second buffer, wherein at least some of the previous data in the second buffer is still retained;

wherein when the instruction does not include the specified type of transforming, block copying at least some of the first data from the first buffer to respective memory locations of the second buffer having same corresponding screen locations, wherein at least some of the previous data in the second buffer is still retained; and rendering the second data from the second buffer onto the display screen.

2. The method as claimed in claim 1, wherein said instruction includes a scroll instruction.

3. The method as claimed in claim 1, further comprising, prior to said receiving, refraining from writing to the second buffer until said instruction is received.

4. The method as claimed in claim 1, wherein said writing includes obtaining some but not all of the first data from the first buffer.

5. The method as claimed in claim 4, wherein the starting buffer memory location of the obtained first data is not the starting buffer memory location of the first buffer.

6. The method as claimed in claim 1, wherein said writing includes writing to some but not all buffer memory locations of the second buffer.

7. The method as claimed in claim 6, wherein the starting buffer memory location of the part of the second buffer written to is not the starting buffer memory location of the second buffer.

8. The method as claimed in claim 1, wherein the method is performed by a processor.

9. A computer device comprising:

a controller;

a display screen having screen locations and coupled to the controller; and memory accessible by the controller for storing a first buffer and a second buffer, each buffer having distinct respective buffer memory locations which correspond to the screen locations of the display screen;

wherein the controller is configured to:

render first data from the first buffer onto the display screen, retain previous data in the second buffer;

receive an instruction for changing what is displayed on the display screen;

when the instruction includes a specified type of transforming, write, to the second buffer, second data based on at least some of the first data by changing corresponding screen locations of at least some first data from the first buffer, by block copying said at least some first data, which corresponds to first screen locations, to respective memory locations of the second buffer which correspond to second screen locations different from said respective first screen locations, by writing at most once to each buffer memory location of the second buffer, wherein at least some of the previous data in the second buffer is still retained, wherein when the instruction does not include the specified type of transforming, block copy at least some of the first data from the first buffer to respective memory locations of the second buffer having same corresponding screen locations, wherein at least some of the previous data in the second buffer is still retained, and render the second data from the second buffer onto the display screen.

10. The computer device as claimed in claim 9, wherein said instruction includes a scroll instruction.

11. The computer device as claimed in claim 9, wherein the controller is further configured to, prior to said receiving, refrain from writing to the second buffer until said instruction is received.

12. The computer device as claimed in claim 9, wherein said writing to the second buffer includes obtaining some but not all of the first data from the first buffer.

13. The computer device as claimed in claim 12, wherein the starting buffer memory location of the obtained first data is not the starting buffer memory location of the first buffer.

14. The computer device as claimed in claim 9, wherein said writing to the second buffer includes writing to some but not all buffer memory locations of the second buffer.

15. The computer device as claimed in claim 14, wherein the starting buffer memory location of the part of the second buffer written to is not the starting buffer memory location of the second buffer.

16. A method for rendering, onto screen locations of a display screen, data from a memory having a first buffer and a second buffer, each buffer having distinct respective buffer memory locations which correspond to the screen locations of the display screen, the method comprising:

rendering first data from the first buffer onto the display screen;

retaining previous data in the second buffer;

waiting for an instruction for changing what is displayed on the display screen;

receiving the instruction; and when the instruction includes a specified type of transforming, selectively writing, to the second buffer, second data by block copying at least some of the first data from the first buffer, wherein at least some of the previous data in the second buffer is still retained, wherein when the instruction includes an end instruction, refraining from copying from the first buffer.

17. The method as claimed in claim 16, further comprising determining whether the instruction includes steps which can be combined into a single step, and wherein said selectively writing includes writing at most once to each buffer memory location of the second buffer to perform the instruction.

18. The method as claimed in claim 16, further comprising performing said instruction.

19. The method as claimed in claim 16, wherein the instruction includes a draw instruction, and wherein the method further comprises performing the draw instruction onto the second data contained in the second buffer.

20. The method as claimed in claim 16, wherein said selectively writing includes writing, to the second buffer, by performing at least one of transforming at least some first data from the first buffer and changing corresponding screen locations of at least some first data from the first buffer, by writing at most once to each buffer memory location of the second buffer.

21. The method as claimed in claim 16, wherein said selectively writing includes obtaining some but not all of the first data from the first buffer.

22. The method as claimed in claim 16, wherein said selectively writing includes writing to some but not all buffer memory locations of the second buffer.

23. The method as claimed in claim 21, wherein the method is performed by a processor.

* * * * *